US007197269B2

(12) United States Patent
Omata et al.

(10) Patent No.: US 7,197,269 B2
(45) Date of Patent: Mar. 27, 2007

(54) METHOD, SYSTEM AND APPARATUS FOR TRANSFERRING TONER IMAGES TO BOTH SIDES OF A RECORDING MEDIUM

(75) Inventors: Yasukuni Omata, Kanagawa (JP); Hideaki Mochimaru, Kanagawa (JP); Chiemi Kaneko, Ibaraki (JP); Koji Suzuki, Kanagawa (JP); Naoki Iwata, Saitama (JP); Kunihiko Tomita, Kanagawa (JP); Hiroshi Yokoyama, Kanagawa (JP); Norimasa Sohmiya, Saitama (JP); Shigeru Watanabe, Kanagawa (JP); Hisao Murayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 60 days.

(21) Appl. No.: 10/680,091

(22) Filed: Oct. 8, 2003

(65) Prior Publication Data

US 2004/0131398 A1 Jul. 8, 2004

(30) Foreign Application Priority Data

Oct. 11, 2002 (JP) ..... 2002-298198
Dec. 12, 2002 (JP) ..... 2002-360264
Feb. 20, 2003 (JP) ..... 2003-042596

(51) Int. Cl.
*G03G 15/20* (2006.01)

(52) U.S. Cl. ..... 399/309

(58) Field of Classification Search ..... 399/302, 399/306, 308, 309; 355/24
See application file for complete search history.

(56) References Cited

U.S. PATENT DOCUMENTS 5,561,510 A * 10/1996 Kamp et al. ..... 399/308
5,732,314 A * 3/1998 Tsukida et al. ..... 399/302
5,815,783 A * 9/1998 Lior et al. ..... 399/302
6,011,945 A * 1/2000 Kim ..... 399/309

(Continued)

FOREIGN PATENT DOCUMENTS

JP 62240987 A * 10/1987

(Continued)

OTHER PUBLICATIONS

U.S. Appl. No. 09/915,398, filed Jul. 27, 2001, Mochimaru et al.

(Continued)

*Primary Examiner*—Robert Beatty
(74) *Attorney, Agent, or Firm*—Oblon, Spivak, McClelland, Maier & Neustadt, P.C.

(57) ABSTRACT

An image transferring device of the present invention includes a first and a second intermediate image transfer body whose surfaces endlessly move while forming a nip in contact with each other. When a sheet nipped by the nip is being conveyed toward a side downstream of the nip in the direction in which the above surfaces move, a first toner image transferred from an image carrier to the second intermediate image transfer body via the first intermediate image transfer body beforehand is transferred to one side of the sheet. At the same time, a second toner image transferred from the image carrier to the first image transfer body beforehand is transferred to the other side of the sheet. One of the two intermediate image transfer bodies is less deformable than the other intermediate image transfer body in the direction of thickness.

19 Claims, 9 Drawing Sheets

U.S. PATENT DOCUMENTS

| | | | | |
|---|---|---|---|---|
| 6,492,084 | B2 | 12/2002 | Tomita | |
| 6,574,448 | B2 | 6/2003 | Mochimaru et al. | |
| 6,584,295 | B2 | 6/2003 | Omata et al. | |
| 6,608,985 | B2 | 8/2003 | Mochimaru et al. | |
| 6,633,733 | B2 | 10/2003 | Mochimaru et al. | |
| 6,643,489 | B2 | 11/2003 | Omata et al. | |
| 6,653,039 | B2 | 11/2003 | Tomita | |
| 6,983,117 | B2 * | 1/2006 | Sohmiya et al. | 399/307 |
| 6,985,687 | B2 * | 1/2006 | Mochimaru et al. | 399/309 |

FOREIGN PATENT DOCUMENTS

| | | | |
|---|---|---|---|
| JP | 1-209470 | | 8/1989 |
| JP | 08160703 | A * | 6/1996 |
| JP | 9-258518 | | 10/1997 |
| JP | 2000-250272 | | 9/2000 |
| JP | 2001-305805 | | 11/2001 |
| JP | 2002-049212 | | 2/2002 |
| JP | 2002049212 | A * | 2/2002 |
| JP | 2002-189358 | | 7/2002 |

OTHER PUBLICATIONS

U.S. Appl. No. 09/933,153, filed Aug. 21, 2001, Tomita et al.
U.S. Appl. No. 09/962,681, filed Sep. 26, 2001, Omata et al.
U.S. Appl. No. 10/052,433, filed Jan. 23, 2002, Tamiya et al.
U.S. Appl. No. 10/158,069, filed May 31, 2002, Matsuda et al.
U.S. Appl. No. 10/161,742, Jun. 5, 2002, Mochimaru et al.
U.S. Appl. No. 10/176,672, filed Jun. 24, 2002, Omata et al.
U.S. Appl. No. 10/200,519, filed Jul. 23, 2002, Tomita et al.
U.S. Appl. No. 10/289,315, filed Nov. 7, 2002, Iwata.
U.S. Appl. No. 10/247,631, filed Sep. 20, 2002, Tomita et al.
U.S. Appl. No. 10/252,104, Sep. 23, 2002, Mochimaru et al.
U.S. Appl. No. 10/307,383, filed Dec. 2, 2002, Yokoyama.
U.S. Appl. No. 10/321,455, filed Dec. 18, 2002, Omata et al.
U.S. Appl. No. 10/310,892, filed Dec. 6, 2002, Omata et al.
U.S. Appl. No. 10/355,039, filed Jan. 31, 2003, Suzuki et al.
U.S. Appl. No. 10/424,077, filed Apr. 28, 2003, Suzuki et al.
U.S. Appl. No. 10/456,583, filed Jun. 9, 2003, Fujisharo et al.
U.S. Appl. No. 10/680,091, filed Oct. 8, 2003, Omata et al.
U.S. Appl. No. 11/017,970, filed Dec. 22, 2004, Kaneko.
U.S. Appl. No. 11/105,427, Apr. 14,2005, Tomita.
U.S. Appl. No. 11/184,956, filed Jul. 20, 2005, Ishii et al.
U.S. Appl. No. 11/226,314, filed Sep. 15, 2005, Mochimaru et al.
U.S. Appl. No. 11/370,853, filed Mar. 9, 2006, Omata.

* cited by examiner

METHOD, SYSTEM AND APPARATUS FOR TRANSFERRING TONER IMAGES TO BOTH SIDES OF A RECORDING MEDIUM

BACKGROUND OF THE INVENTION

1. Field of the Invention

The present invention relates to an electrophotographic image forming apparatus and more particularly to an image transferring device configured to transfer color images to both sides of a recording medium substantially at the same time without switching back the recording medium, and an image forming apparatus including the same.

2. Description of the Background Art

Generally, two different systems, i.e., a switchback system and a one-pass system are available for transferring toner images to both sides of a sheet or similar recording medium. The switchback system conveys a sheet via image transferring means to thereby transfer a toner image from a photoconductive drum or similar image carrier to one side of the sheet, switches back the sheet, and then transfer another toner image to the other side of the sheet. On the other hand, the one-pass system transfers toner images to both sides of a sheet with image transferring means substantially at the same time without switching back the sheet. The one-pass system is advantageous over the switchback system in that it is free from an increase in cost and an increase in image forming time ascribable to a sophisticated switchback mechanism. An image forming apparatus implementing the one-pass system is disclosed in, e.g., Japanese Patent Laid-Open Publication No. 1-209470.

We are currently developing an image forming apparatus using a first and a second intermediate image transfer body as an improvement over the conventional one-pass system. In the improved apparatus, the first and second intermediate image transfer bodies are held in contact with each other and caused to endlessly move while forming a nip therebetween. When a sheet nipped by the above nip is being conveyed toward a side downstream of the nip in the direction of belt movement, a first toner image transferred from an image carrier to the second intermediate image transfer body via the first intermediate image transfer body beforehand is transferred to the first side of the sheet. At the same time, a second toner image transferred from the image carrier to the first intermediate image transfer body beforehand is directly transferred to the second side of the sheet. Because the sheet does not directly contact the image carrier, paper dust, when a paper sheet is used, does not deposit on the image carrier or bring about troubles including the degradation of image quality.

However, the improved apparatus described above is apt to cause a sheet to crease at the time when toner images are transferred to both sides of the sheet. It was experimentally found that creases were conspicuous particularly when the first and second intermediate image transfer bodies each were implemented as a belt passed over a plurality of rollers and caused to endlessly move. We found the following as a result of extended researches and experiments. Generally, the first and second intermediate image transfer bodies are configured to exhibit elasticity, so that they can closely contact a sheet for thereby enhancing transferability. However, when the two intermediate image transfer bodies with high elasticity are pressed against each other to form a nip, their surfaces elastically deform in a complicated manner at the nip and bite into each other in the form of wedges. When a sheet is conveyed via such a nip, it creases in accordance with the configuration of the creases.

Japanese Patent Laid-Open Publication No. 9-258518 discloses an image forming apparatus including a single photoconductive drum and a plurality of developing units arranged around the drum and each storing toner of a particular color. First, exposure and development are repeated color by color with the drum to thereby form a composite color toner image for the first side of a sheet on the drum. The color toner image is then electrostatically transferred from the drum to a first intermediate image transfer body and then electrostatically transferred to a second intermediate image transfer body. Subsequently, a composite color image for the second side of the sheet is formed on the drum by the same procedure and then electrostatically transferred to the first intermediate image transfer body. Thereafter, the toner images are electrostatically transferred from the second intermediate image transfer body or acceptor and first intermediate image transfer body to both sides of a sheet. In this manner, the apparatus electrostatically effects all of the consecutive image transfer.

Generally, electrostatic image transfer is desirable when effected at a position where a sheet and an image carrier closely contact each other. However, at a position where the sheet and image carrier do not closely contact each other within an image transfer zone, electrostatic image transfer brings about toner scattering or blurring due to discharge, which occurs in the event of contact and separation of the sheet, and the influence of an electric field. The resulting images lack sharpness.

Further, Japanese Patent Laid-Open Publication No. 2000-250272 teaches a tandem image forming apparatus including four photoconductive drums arranged side by side, a first intermediate image transfer belt or body contacting the drums, and a second intermediate image transfer belt or body selectively movable into or out of contact with the first intermediate image transfer body. First, toner images are formed on the drums in accordance with image data read from the first side of a document while being sequentially transferred to the first intermediate image transfer belt one above the other, completing a color toner image. The color toner image is then transferred to the second intermediate image transfer belt by heating means associated with the first intermediate image transfer belt. Subsequently, another color toner image derived from image data read from the second side of the document is completed on the first intermediate image transfer belt. When a sheet is conveyed to a position between the first and second intermediate image transfer belts, the color toner images are transferred from the first and second intermediate image transfer belts to both sides of the sheet and fixed on the sheet at the same time by the heating means associated with the first intermediate image transfer belt.

The apparatus taught in the above document applies electrostatic image transfer to primary image transfer from the drums to the first intermediate image transfer belt and applies thermal image transfer to secondary image transfer from the first intermediate image transfer belt to the second intermediate image transfer belt and image transfer from the two belts to both sides of a sheet. With this scheme, it is possible to reduce toner scattering and blurring ascribable to electrostatic image transfer. However, because the toner images are fixed on both sides of a sheet at the same time as they are transferred from the two belts, the two belts are heated to high temperature. It is therefore necessary to use cooling means for cooling off the two belts after image transfer to temperature below the softening point of toner. The apparatus is not practical when applied to a high speed machine because it cannot save energy and because the cooling means increases the overall size of the apparatus.

SUMMARY OF THE INVENTION

It is a first object of the present invention to provide a one-pass type of image forming apparatus capable of reducing the deposition of paper dust on an image carrier and protecting a sheet from creases, and an image forming apparatus including the same.

It is a second object of the present invention to provide an image transferring device capable of protecting toner images from degradation ascribable to electrostatic image transfer and saving energy, and an image forming apparatus including the same.

An image transferring device of the present invention includes a first and a second intermediate image transfer body whose surfaces endlessly move while forming a nip in contact with each other. When a sheet nipped by the nip is being conveyed toward a side downstream of the nip in the direction in which the above surfaces move, a first toner image transferred from an image carrier to the second intermediate image transfer body via the first intermediate image transfer body beforehand is transferred to one side of the sheet. At the same time, a second toner image transferred from the image carrier to the first image transfer body beforehand is transferred to the other side of the sheet. One of the two intermediate image transfer bodies is less deformable than the other intermediate image transfer body in the direction of thickness.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
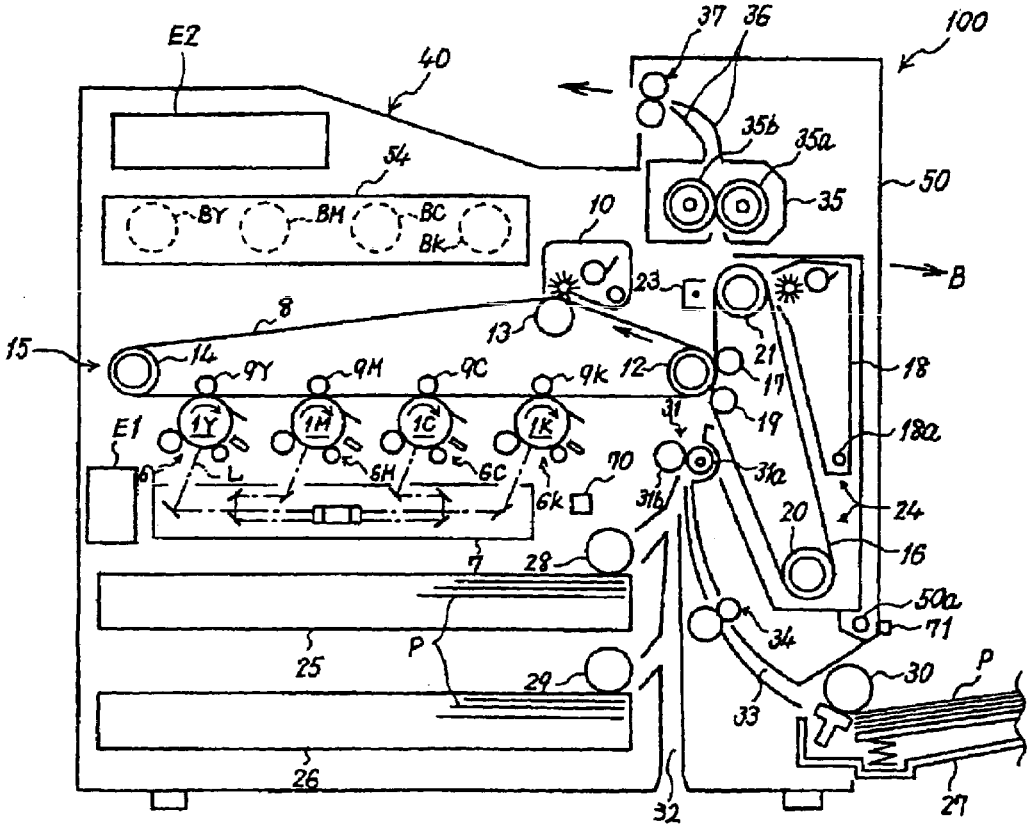
FIG. 1 is a view showing the general construction of an image forming apparatus embodying the present invention.

Referring to FIG. 1 of the drawings, an image forming apparatus embodying the present invention is shown and implemented as an electrophotographic printer by way of example. The illustrative embodiment is mainly directed toward the first object stated earlier. As shown, the printer, generally 100, includes four process cartridges 6Y (yellow), 6M (magenta), 6C (cyan) and 6K (black). The process cartridges 6Y through 6K are identical in configuration with each other except for the color of toner to use, and each is replaced when its life ends.

Figure 2:
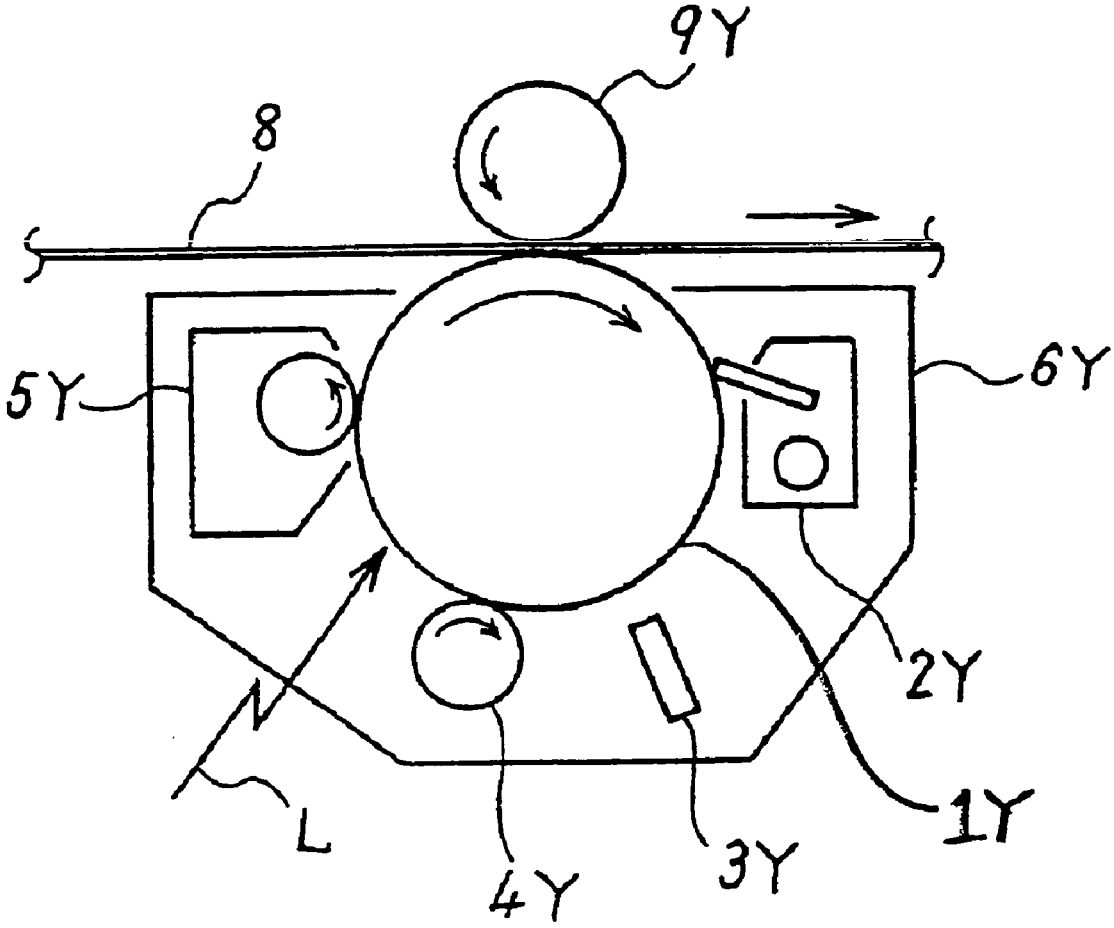
FIG. 2 is a fragmentary view showing one of process units included in the illustrative embodiment.

FIG. 2 shows a specific configuration of the process cartridge 6Y for forming a Y or yellow toner image by way of example. As shown, the process cartridge 6Y includes a photoconductive drum or image carrier 1Y, a drum cleaner 2Y, a quenching or discharging device 3Y, a charger 4Y, and a developing device 5Y. The drum 1Y is made up of a hollow cylinder formed of drum and having a diameter of 30 mm to 100 mm and a surface layer formed on the cylinder and formed of an organic photoconductor. The surface layer may alternatively be implemented by amorphous silicone. The drum 1Y may be replaced with a photoconductive belt, if desired The charger 4Y uniformly charges the surface of the drum 1Y being rotated clockwise, as viewed in FIG. 1, by drive means not shown. A laser beam L scans the charged surface of the drum 1Y in accordance image data to thereby form a Y latent image. The developing device 5Y develops the Y latent image with Y toner for thereby producing a corresponding Y toner image. The Y toner image is transferred to a first intermediate image transfer belt (simply first belt hereinafter) 8, which will be described specifically later. Let this image transfer be referred to as primary image transfer. After the primary image transfer, the drum cleaner 2Y removes the toner left on the surface of the drum 1Y. Subsequently, the quenching device 3Y dissipates charge left on the drum 1Y, i.e., discharges the surface of the drum 1Y to thereby prepare it for the next image forming cycle.

Likewise, an M, a C and a K toner image are respectively formed on drums 1M, 1C and 1K and sequentially transferred to the belt 8 by primary image transfer. Each developing device may use either one of a two-component developer, i.e., a toner and a magnetic carrier mixture and a one-component developer, i.e., toner only. Further, the toner may be either one of pulverized toner and spherical toner and should preferably have a grain size of about 6 μm.

An exposing unit or latent image forming means 7 is positioned below the process cartridges 6Y through 6K while an image data processing unit E1 is positioned at the left-hand side of the exposing unit 7, as viewed in FIG. 1. The image data processing unit E1 generates a scanning control signal in accordance with image data received from, e.g., a personal computer while sending the scanning control signal to the exposing unit 7. The exposing unit 7 emits laser beams L in accordance with the scanning control signal toward the drums 1Y through 1K of the process cartridges 6Y through 6K. The laser beams L respectively scan the drums 1Y through 1K to thereby form latent images.

In the illustrative embodiment, the exposing unit 7 includes a polygonal mirror driven by a motor to steer the laser beams L issuing from lasers, and a plurality of lenses and mirrors. Alternatively, use may be made of exposing means using an LED (Light Emitting Diode) array. A seal member, not shown, seals the casing of the exposing unit 7 in order to protect the inside of the exposing unit 7 from contamination ascribable to toner that may drop from the drums 1Y through 1K.

A first and a second sheet cassette 25 and 26 are located below the exposing unit 7, as viewed in FIG. 1, and positioned one above the other. The first and second sheet cassettes 25 and 26 each are loaded with a stack of sheets or recording media P. A first and a second pickup roller 28 and 29 are associated with the first and second sheet cassettes 25 and 26, respectively. A manual sheet feed tray 27 is positioned at the right-hand side of the second sheet cassette 26, as viewed in FIG. 1, and provided with a pickup roller 30. The manual sheet feed tray 27 protrudes to the outside of the casing of the printer body and may be loaded with sheets, as desired.

Sheet paths 32 and 33 respectively extend from the sheet cassettes 25 and 26 and manual sheet feed tray 27 and join each other at a first and a second registration roller 31*a* and 31*b*. A roller pair 34 for conveyance is positioned on the sheet path 33. The pickup rollers 28 and 29 respectively rest on the top sheets of the sheet cassettes 25 and 26. Drive means, not shown, causes either one of the pickup rollers 28 and 29 to rotate and pay out the top sheet P toward the sheet path 32.

The first and second registration rollers 31*a* and 31*b* rotate in the same direction as each other, as viewed at a position where they contact each other. The registration rollers 31*a* and 31*b* nip the leading edge of the sheet P fed from the sheet cassette 25 or 26 and immediately stops rotating. Subsequently, the registration rollers 31*a* and 31*b* again start rotating at preselected timing to thereby convey the sheet P toward a secondary image nip, which will be described specifically later. In this sense, the registration rollers 31*a* and 31*b* play the role of a timing roller pair.

On the other hand, the pickup roller 30, resting on the top of sheets P stacked on the manual sheet feed tray 27, pays out the top sheet P toward the registration rollers 31*a* and 31*b* via the roller pair 34 positioned on the sheet path 33. This sheet P is nipped by the registration rollers 31*a* and 31*b* in the same manner as the sheet P fed from the sheet cassette 25 or 26.

A first image transferring unit 15 is arranged above the process cartridges 6Y through 6K, as viewed in FIG. 1. The first image transferring unit 15 includes four image transfer rollers or bias rollers 9Y through 9K, a first belt cleaner 10, a backup roller 12 for secondary image transfer, a backup roller 13 for cleaning and a tension roller 14 in addition to the first belt 8 mentioned earlier. The first belt, or first intermediate image transfer body, 8 is passed over the rollers 12 through 14 and caused to turn counterclockwise, as viewed in FIG. 1, by anyone of the rollers 12 through 14. The image transfer rollers 9Y through 9K nip the first belt 8 between them and the drums 1Y through 1K, respectively, forming respective primary image transfer nips. The image transfer rollers 9Y through 9K, connected to power supplies not shown, apply biases for primary image transfer to the inner surface of the loop of the first belt 8. The biases are opposite in polarity to the toner, e.g., positive biases. The other rollers 12 through 14 all are electrically grounded.

A Y toner image to a K toner image formed on the drums 1Y through 1K, respectively, are sequentially transferred to the first belt 8 one above the other at the consecutive primary image transfer nips by nip pressure and biases, completing a four-color toner image.

The backup roller 12 for secondary image transfer is so positioned as to bite into a second intermediate image transfer belt (simply second belt hereinafter) 16, which will be described specifically later. In this condition, the first and second belts 8 and 16 contact each other over a substantial circumferential length, forming a secondary image transfer nip. The belts 8 and 16 move in the same direction as each other, as seen at the secondary image transfer nip. The four-color toner image is transferred from the first belt 8 to the second belt 16 or the sheet P at the secondary image transfer nip. Secondary image transfer refers to this image transfer effected at the secondary image transfer nip.

The first belt cleaner 10 removes residual toner left on the first belt 8 after the secondary image transfer. More specifically, the belt cleaner 10 and backup roller, respectively contacting the outer surface and inner surface of the first belt 8, nip the belt 8. The belt cleaner 10 removes the residual toner either mechanically or electrostatically to thereby clean the belt 8.

The four primary image transfer rollers 9Y through 9K configured to apply biases may be replaced with chargers including discharge electrodes, if desired.

A second image transferring unit 24 is positioned at the right-hand side of the primary image transferring unit 15, as viewed in FIG. 1. The second image transferring unit 24 includes a second belt cleaner 18, an image transfer charger 23, a secondary image transfer roller 17, a nip extension roller 19, a tension roller 20 and a backup roller 21 in addition to the second belt 16. The second belt 16 is passed over the rollers 17, 19, 20 and 21 and caused to turn clockwise, as viewed in FIG. 1, by any one of the rollers 17, 19, 20 and 21. The backup roller 12 bites into part of the second belt 16 extending between the secondary image transfer roller 17 and the nip extension roller 19, forming the secondary image transfer nip. The secondary image transfer roller, or bias roller, 17 is formed of metal or made up of a metallic core and a conductive rubber layer covering the core. A power supply, not shown, applies a bias for secondary image transfer to the secondary image transfer roller 17. This bias is also opposite in polarity to the toner, e.g., a positive bias. The other rollers of the second image transferring unit 24 all are electrically grounded.

The registration roller pair 31 starts conveying the sheet P toward the secondary image transfer nip at such timing that the leading edge of the sheet P meets the leading edge of the four-color toner image being conveyed by the first belt 8. It should be noted that when the four-color toner image on the first belt 8 is a first toner image to be transferred to the first side of the sheet P, i.e., to face upward on a stack tray 40, which will be described later, the registration roller pair 31 does not start conveying the sheet P. In this case, the first toner image is transferred from the first belt 8 to the second belt 16 by nip pressure and bias at the secondary image transfer nip.

On the other hand, when the four-color toner image on the first belt 8 is a second toner image to be transferred to the second side of the sheet P, i.e., to face downward on the stack tray 40, the registration roller pair 31 starts conveying the sheet P at the particular timing mentioned above. The second toner image is therefore transferred from the first belt 8 to the second side of the sheet P at the secondary image transfer nip, completing a full-color image in combination with white, which is the color of the sheet P. At the same time, the first toner image, being conveyed by the second belt 16, is brought into contact with the first side of the sheet P at the secondary image transfer nip. It is to be noted that although the first toner image closely contacts the first side of the sheet P because of the secondary image transfer bias, the former is not transferred to the latter at this stage.

More specifically, the backup roller 12 included in the primary image transfer unit 15 presses the first belt 8 such that the direction of movement of the belt 8 is almost reversed. In this condition, part of the belt 8 being so reversed in direction of movement contacts the second belt 16, forming the secondary image transfer nip. Consequently, at the outlet of the secondary image transfer nip, the first belt

8 leaves the sheet P while the second belt 16 conveys the sheet P to a tertiary image transfer position alone.

At the tertiary image transfer position, also included in the second image transferring unit 24, the image transfer charger 23 faces part of the second belt 16 passed over the backup roller 21 at a preselected distance. The image transfer charger 23 applies a charge opposite in polarity to the toner, e.g., a positive charge to the second side of the sheet P. As a result, the first toner image held between the first side of the sheet P and the second belt 16 is transferred to the first side of the sheet P, completing a full-color image. Tertiary image transfer refers to image transfer thus effected at the tertiary image transfer position.

As stated above, the two image transferring units 15 and 24 cooperate to transfer the second toner image from the belt 8 to the second side of the sheet P at the secondary image transfer nip and then transfer the first toner image from the belt 16 to the first side of the sheet P at the tertiary image transfer position. The rollers 9 and 17, serving as bias applying members, may be replaced with, e.g., brushes, if desired. Further, such an electrostatic image transfer system may be replaced with a non-contact discharge system.

The sheet P, carrying the full-color toner images on both sides thereof, is separated from the second belt 16 and conveyed to a fixing unit 35, which will be described specifically later. Part of the second belt 16 moved away from the tertiary image transfer position is nipped between the backup roller 21 and the second belt cleaner 18, so that residual toner left on the belt 16 is removed either mechanically or electrostatically.

A moving mechanism, not shown, angularly moves the second belt cleaner 18 about a shaft 18*a* into or out of contact with the second belt 16, as indicated by an arrow in FIG. 1. At least when the first toner image is being conveyed by the second belt 16 via the second belt cleaner 18, the moving mechanism maintains the belt cleaner 18 spaced from the belt 16 for thereby preventing the first toner image from being removed.

The fixing unit or fixing means 35 is positioned above the second image transferring unit 24, as viewed in FIG. 1, and includes two fixing rollers 35*a* and 35*b* each accommodating a respective halogen lamp or similar heating means. The rollers 35*a* and 35*b* contact each other and rotate in the same direction, as seen at the position where they contact each other, forming a nip for fixation. When the rollers 35*a* and 35*b* heat the sheet P while conveying it via the above nip, the full-color images on the sheet P are softened and fixed on the sheet P.

The sheet P, coming out of the fixing unit 35, is turned along guide members 36 and then driven out to the stack tray 40 by an outlet roller pair 37. The stack tray 40 is implemented by the top of the casing of the printer body.

Particular temperature sensing means is assigned to each of the fixing rollers 35*a* and 35*b* for sensing surface temperature of the roller. The outputs of the temperature sensing means are sent to a control unit E2 positioned in the uppermost portion of the printer body. The control unit E2 selectively turns on or turns off the heating means of the rollers 35*a* and 35*b* in accordance with the outputs of the temperature sensing means, thereby maintaining the surface temperatures of the rollers 35*a* and 35*b* in a preselected target range. In a simplex print mode for forming an image on only one side of the sheet P, an image can be fixed by a smaller amount of heat than in a duplex print mode because the amount of toner on the sheet P is smaller. Therefore, by lowering the target range in the simplex print mode, it is possible to save energy. Further, to save energy, the target range may be switched between a monochromatic print mode and a full-color print mode in consideration of the fact that a monochromatic image is formed by a smaller amount of toner than a full-color image.

As stated above, in the illustrative embodiment, while the sheet P is being conveyed from the secondary image transfer nip toward the upstream side in the direction of sheet conveyance, i.e., by a one-pass system, the toner images are transferred to both sides of the sheet. Further, paper dust is prevented from depositing on the drums 1Y through 1K because the sheet P does not contact the drums 1Y through 1K at all.

The printer 100 has a tandem configuration in which the drums or similar image carriers 1Y through 1K are arranged side by side, as stated above. Another conventional image forming system is configured to repeatedly transfer toner images from a single image carrier to an intermediate image transfer body one above the other. This image forming system, however, must repeat the formation of a toner image and transfer of the same. By contrast, the tandem image forming system noticeably reduces the image forming time.

The first image, formed before the second toner image, is transferred from the first belt 8 to the second belt 16 at the secondary image transfer nip and then transferred to the first side of the sheet P at the tertiary image transfer position, as stated earlier. The first side of the sheet P faces upward on the stack tray 40. Therefore, consecutive sheets P are sequentially stacked on the stack tray 40 with their first toner images facing upward.

In the illustrative embodiment, to sequentially stack sheets P in incrementing order as to page number, the image of larger one of odd and even pages is formed as the first toner image before the toner image of the other page. For example, the image of the second page is formed as the first toner image before the image of the first page. This allows even the prints of several consecutive documents to be sequentially stacked in order of page from the bottom to the top. On the other hand, in a simplex print mode that forms images only on the second sides of sheets P, the images of consecutive documents are sequentially formed in incrementing order as to page number and transferred to the second sides of sheets P by secondary image transfer. The resulting prints can also be stacked on the stack tray 40 in order of page from the bottom to the top.

Toner images, formed on the drums 1Y through 1K and expected to form the second toner images, are non-mirror images. This is because each of such toner images becomes a mirror image in the event of primary image transfer and then becomes a non-mirror image in the event of secondary image transfer, i.e., on the second side of the sheet P. However, a toner image, expected to form the first toner image, is transferred one time more than the second toner image because of tertiary image transfer and therefore formed on each drum as a mirror image.

A bottle storage 54 is positioned above the first image transferring unit 15 and stores toner bottles BY, BM, BC and BK. The toner bottles BY through BK are packed with fresh toners to be replenished to the process cartridges 6Y through 6K, respectively.

Figure 3:
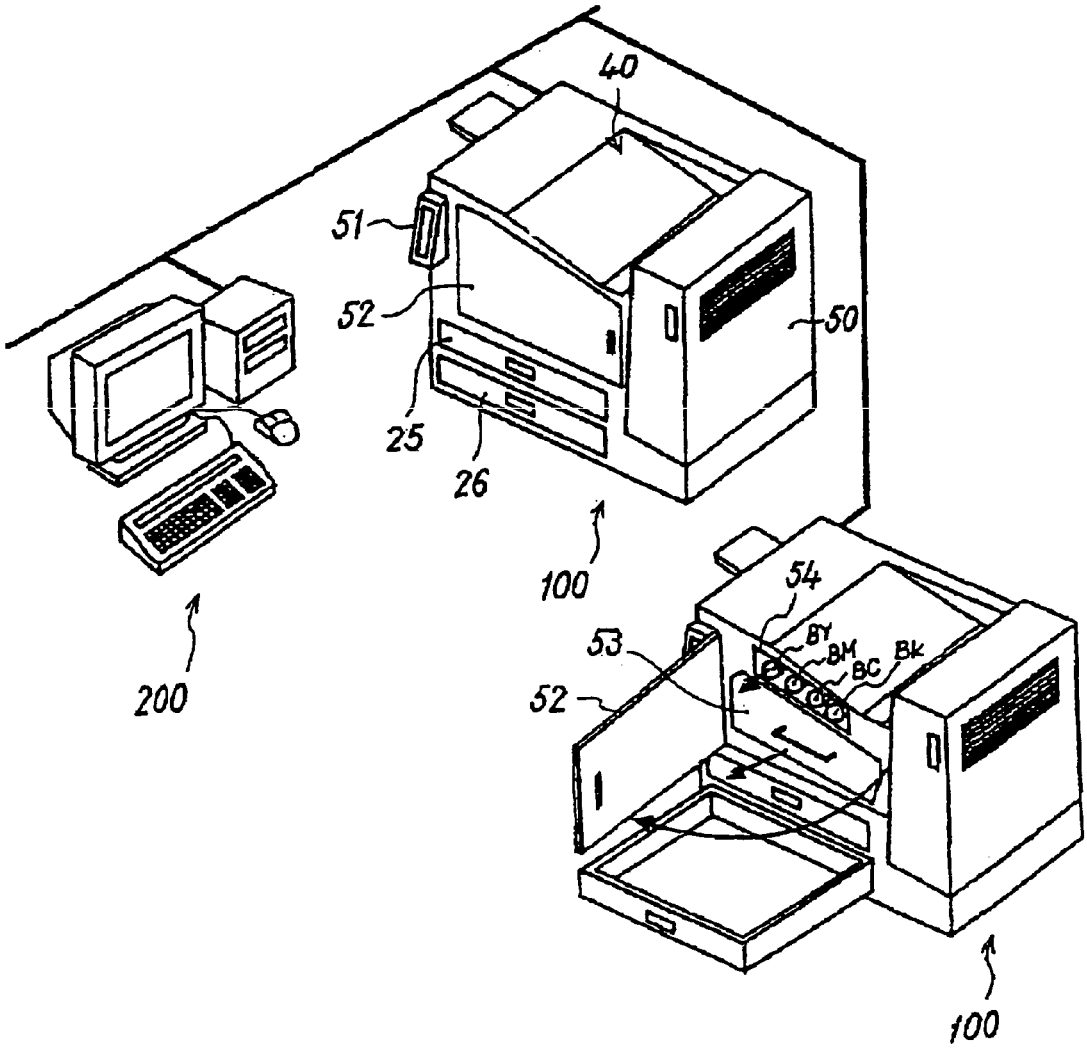
FIG. 3 is a perspective view showing a specific image forming system including the apparatus of the illustrative embodiment and a personal computer.

As shown in FIG. 3, the printer 100 forms images in accordance with image data received from a personal computer 200 or similar host. While the personal computer 200 and printer 100 are shown as being interconnected by a cable, they may, of course, be interconnected by radio. An operation/display unit 51 is mounted on the front left corner of the printer body and may be implemented as a touch panel by way of example. The operator of the printer 100 is expected to input various parameters, including process conditions and sheet conditions, while looking at guidance messages appearing on the display of the unit 51.

More specifically, the operator selects either one of a simplex print mode and a duplex print mode on a mode button available on the operation/display unit 51. Also, the operator selects the kind of sheets, i.e., the sheet cassette on the operation/display unit 51. Alternatively, data representative of a desired mode and a desired kind of sheets may be sent from the personal computer 200 to the printer 100.

A front door 52 is openably mounted on the front of the printer body and uncovers, when opened, a support 53 supporting the first image transferring unit 15, FIG. 1. The support 53 is slidable on guide rails, not shown, in the front-and-rear direction of the printer body. When the support 53 is pulled out toward the front, the first image transferring unit 15 is exposed to the outside and can therefore be easily maintained or inspected. Further, when the front door 52 is opened, the ends of the toner bottles BY through BK disposed in the bottle storage 54 are accessible to be mounted or dismounted. Stated another way, the printer 100 is not configured such that the operator opens the top of the printer body and then mounts or dismounts toner bottles in the up-and-down direction. It follows that even when a scanner, not shown, is mounted to the top of the printer 100 to constitute a copier, the toner bottles BY through BK can be mounted or dismounted, as desired.

The two sheet cassettes 25 and 26 are positioned below the front door 52 and are slidable into or out of the printer body. Therefore, even when the front door 52 is open, the sheet cassettes 25 and 26 can be mounted or dismounted without any obstruction while the operation/display unit 51 can be freely operated.

Figure 4:
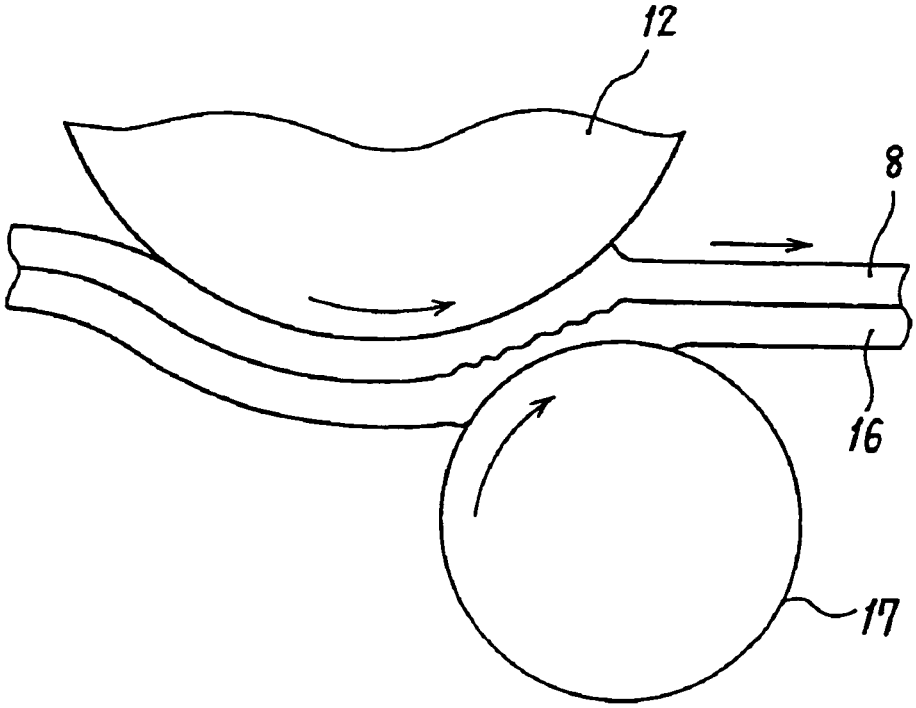
FIG. 4 is an enlarged fragmentary section showing a secondary image transfer nip formed between a first and a second intermediate image transfer belt that are deformable to the same degree in the direction of thickness.

Configurations characterizing the illustrative embodiment will be described hereinafter. Assume that the first and second belts 8 and 16 have substantially the same degree of deformability in the direction of thickness. Then, as shown in FIG. 4, at the secondary image transfer nip, particularly in the position between the backup roller 12 and the secondary image transfer roller 17, the surfaces of the belts 8 and 16 elastically deform in a complicated manner due to the pressure of the rollers 12 and 17. As a result, the above surfaces bite into each other in the form of wedges. Should the sheet P be passed via such a secondary image transfer nip, the sheet P would crease in accordance with the configuration of the wedges.

Figure 5:
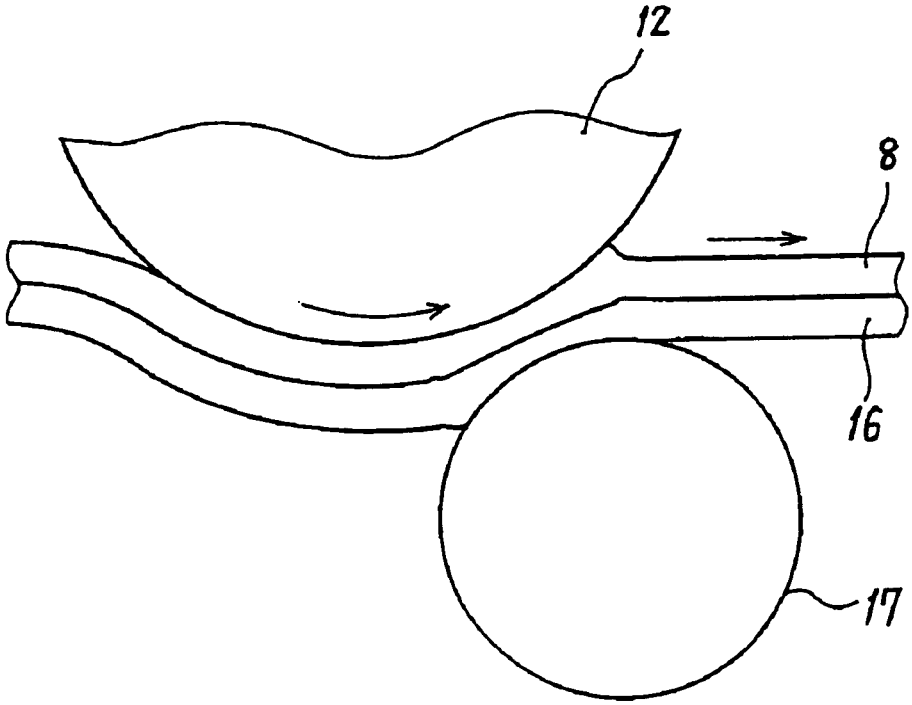
FIG. 5 is a view similar to FIG. 4.

In light of the above, in the illustrative embodiment, the second belt 16 is formed of a material less deformable than the first belt 8 in the direction of thickness. In this condition, the surface of the first belt 8 tends to deform in complementarily to the surface of the second belt 16 at the secondary image transfer nip. As a result, as shown in FIG. 5, the wedge-like bite of the belts 8 and 16 is reduced, so that the belts 8 and 16 more smoothly contact each other and protect the sheet P from creases.

More specifically, in the illustrative embodiment, the second belt 16 has a base formed of resin and provided with surface hardness of 95° in JIS (Japanese Industrial Standards) A scale. The first belt 8 has a base formed of rubber and provided with surface hardness of 50°. When the belt 8 or 16 has a laminate structure, surface roughness is measured by using the entire laminate without exception. Surface roughness thus measured shows how difficult the belt is to deform in the direction of thickness. Therefore, the higher the surface hardness, the more difficult for the belt to deform in the above direction.

As for one of the belts easier to deform in the direction of thickness than the other belt, i.e., the first belt 8 in the illustrative embodiment, surface roughness should preferably be 65° or below in JIS-A scale in order to guarantee a certain degree of tight contact of the two belts at the secondary image transfer nip.

In the illustrative embodiment, the first belt 8 easier to deform than the second belt 16 in the direction of thickness, as stated above, is provided with a laminate structure for the following reason. The first belt 8 is expected to implement electric resistance sufficient to effect electrostatic image transfer while exhibiting desirable elasticity. Usually, therefore, carbon black or similar conductive substance is dispersed in an elastic material, which forms base of the belt, as a resistance control agent. However, elastic materials in general become harder as the content of the resistance control agent increases. Therefore, if the content of the resistance control agent is increased to such a degree that the belt has desired electric resistance, then the elastic material sometimes fails to exhibit elasticity. This is why the first belt 8 is provided with a laminate structure.

In a laminate structure, the content of the resistance control agent can be reduced in an elastic base layer to a certain degree and can be increased in the other layer, e.g., a surface layer or an under layer. It follows that the entire belt achieves both of desired elasticity and desired electric resistance. The layer other than the base layer may be provided with lower surface energy than the base layer and implemented as a surface layer, in which case the surface layer will play the role of a layer for promoting the parting of a toner image. More specifically, the surface layer allows toner to easily part from the first belt 8 at the secondary image transfer nip, obviating defective image transfer ascribable to residual toner. The second belt 16 may, of course, be provided a laminate structure. It is to be noted that the base layer refers to the belt itself when the belt has a single layer structure or refers to the thickest layer when it has a laminate structure.

While resin for the base of the second belt 16 is open to choice, use is made of polyimide in the illustrative embodiment. This is because the base formed of polyimide, which is highly heat-resistant, provides the entire second belt 16 with heat resistance. Polyamide is another resin that makes the second belt 16 resistant to heat. If it is not necessary to provide the entire belt 16 with heat resistance, then there may be used any one of various types of resins including polycarbonate, fluorine-based resin (ETFE, PVDF), methyl methacrylate resin, butyl methacrylate resin, ethyl acrylate resin, and butyl acrylate resin. Also, there may be used any one of modified acryl resin (silicone modified acryl resin, vinyl chloride resin modified acryl resin, acryl-urethane resin, etc.), vinyl chloride resin, styrene-vinyl acetate copolymer, and vinyl chloride-vinyl acetate copolymer. Other resins usable include rosin modified maleic resin, phenol resin, epoxy resin, polyester resin, polyester polyurethane resin, polyethylene, polypropylene, polybutadiene, polyvinylidene chloride, and ionomer resin. Polyurethane resin, silicone resin, ketone resin, ethylene-ethylacrylate copolymer, xylene resin, polyvinylbutyral and modified polyphenylene oxide resin are also usable. For example, styrene-based resin (homopolymer or copolymer containing styrene or styrene substitute) may be used. This styrene-based resin includes polystyrene, chloropolystyrene, poly-α-methylstyrene, styrene-butadiene copolymer, styrene-vinyl chloride copolymer, styrene-vinyl acetate copolymer and styrene-maleic acid copolymer; or, styrene-acrylic ester copolymer (styrene-methyl acrylate copolymer, styrene-ethyl acrylate copolymer, styrene-butyl acrylate copolymer, styrene-octyl acrylate copolymer, styrene-phenyl acrylate copolymer, or the like); or styrene-methacrylic ester copolymer (styrene-methyl methacrylate copolymer, styrene-ethyl methacrylate copolymer, styrene-phenyl methacrylate copolymer, or the like); or styrene-α-methyl chloroacrylate copolymer, and styrene-acrylonitrile-acrylic ester copolymer. Two or more of such resins may be combined, if desired.

Rubber and elastomers for the first belt 8 are also open to choice. For example, there may be used butyl rubber, fluorine-based rubber, acryl rubber, EPDM, NBR, acrylonitrile-butadiene-styrene rubber, natural rubber, isoprene rubber, styrene-butadiene rubber, butadiene rubber, or the like; ethylene-propylene rubber, ethylene-propylene terpolymer, chloroprene rubber, chlorosulfonated polyethylene, chlorinated polyethylene, urethane rubber, or syndiotactic 1,2-polybutadiene or the like; epichlorohydrin-based rubber, silicone rubber, fluorine rubber, polysulfide rubber, polynorbornene rubber, hydrogenated nitrile rubber or the like; or thermoplastic elastomers (such as, polystyrene-based, polyolefinic, polyvinyl chloride-based, polyurethane-based, polyamide-based, polyurea, polyester-based or fluoroplastic-based). Two or more of such materials may be combined, if desired.

The layer formed of rubber or elastomer may be provided on the outer surface or image transfer surface or the inner surface of the resin base, so that the second belt 16 has a laminate structure. Also, to provide the first belt 8 with a laminate structure, a layer formed of any one of the resins mentioned specifically may be formed on the outer surface or the inner surface of the rubber or elastomer base, if desired.

A parting layer may be provided on the surface of the first belt 8 or the second belt 16 in order to reduce adhesion between the toner and the belt for thereby obviating defective secondary or tertiary image transfer while enhancing cleaning. The material of such a parting layer should only be lower in surface energy than the base. For example, use may be made of resin or rubber in which fluorocarbon resin or the powder or the grains of one or more of fluorine compound, carbon fluoride, titanium dioxide and silicone carbide are dispersed. When fluorine-based rubber is used and subject to heat treatment, fluorine can be enriched on the surface of the parting layer to thereby further reduce surface energy.

The resistance control agent dispersed in the belt material is also open to choice. For example, there may be used carbon black, graphite, aluminum, nickel or similar metal powder or tin oxide, titanium oxide, antimony oxide or indium oxide. Also, there may be used potassium titanate, antimony oxide-tin oxide compound (ATO) or similar conductive metal oxide. If desired, such a conductive material may be replaced with fine grains of barium sulfate, magnesium silicate, potassium carbonate or similar insulating material. The resistance control agent, of course, serves to increase the electric resistance of the belt.

The first and second belts 8 and 16 may be produced by any one of conventional methods. For example, there may be used a centrifugal molding method in which the material of the belt is introduced into a hollow, cylindrical mold being rotated, a spray coating method in which a liquid paint is sprayed to form a film, a dipping method in which a hollow, cylindrical mold is dipped in a liquid and then lifted, a molding method in which a material is introduced into a space between an inner and an outer mold, or a method in which a compound is wrapped round a cylindrical mold and then polished by vulcanization. Two or more of such methods maybe combined, if desired.

While the first and second belts 8 and 16, each being passed over a plurality of rollers, may be replaced with, e.g., drums or rollers, the belts 8 and 16 are advantageous over such substitutes for the following reasons. When one belt is deformed in such a manner as to wrap round part of the other belt passed over a support member as at the secondary image transfer nip shown in FIG. 1, it is possible to form a long secondary image transfer nip for thereby guaranteeing a long contact time of the four-color toner image and the sheet P or the second belt 16. This allows the process linear velocity to be increased to reduce the image forming time. Further, the two belts can be arranged in various configurations and can therefore be laid out more freely than rollers or drums.

The first and second belts 8 and 16 each have surface resistance controlled in a range of $10^5$ Ω·cm$^2$ to $10^{12}$ Ω·cm$^2$. If the surface resistance is lower than $10^5$ Ω·cm$^2$, then the bias applied to the inner surface of the belt for image transfer leaks to the drum or the grounding member contacting the outer surface of the belt, obstructing electrostatic image transfer. If the surface resistance is higher than $10^{12}$ Ω·cm$^2$, then the current to flow to the belt is short and also obstructs electrostatic image transfer.

Why the base of the second belt 16 is formed of polyimide will be described hereinafter. If the distance between the second belt 16 and the fixing unit 35, which generates heat as high as 140° C. or so, then the belt 16 is heated by the fixing unit 35 and deteriorated, if low in heat resistance, to bring about various troubles. Although the distance between the belt 16 and the fixing unit 35 may be increased to obviate the troubles, such a distance prevents the sheet P, which naturally bends due to gravity, from being directly handed over from the belt 16 to the fixing unit 35 and therefore results in the need for a guide member for guiding the sheet P. The guide member rubs and therefore disfigures the toner image carried on the reverse surface of the sheet P being supported by the belt 16. Polyimide, forming the base of the belt 16, provides the entire belt 16 with heat resistance and therefore allows the belt 16 to be positioned close to the fixing unit 35. This successfully obviates the troubles ascribable to the heat of the fixing unit 35.

In the illustrative embodiment, the thickness of the second belt 16 is selected to fall between 50 μm and 600 μm. Thickness below 50 μm makes the second belt 16 easily tear while thickness above 600 μm makes the elastic resin base excessively thick and thereby makes it difficult for the second belt to be less deformable than the first belt 8 in the direction of thickness.

Figure 6:
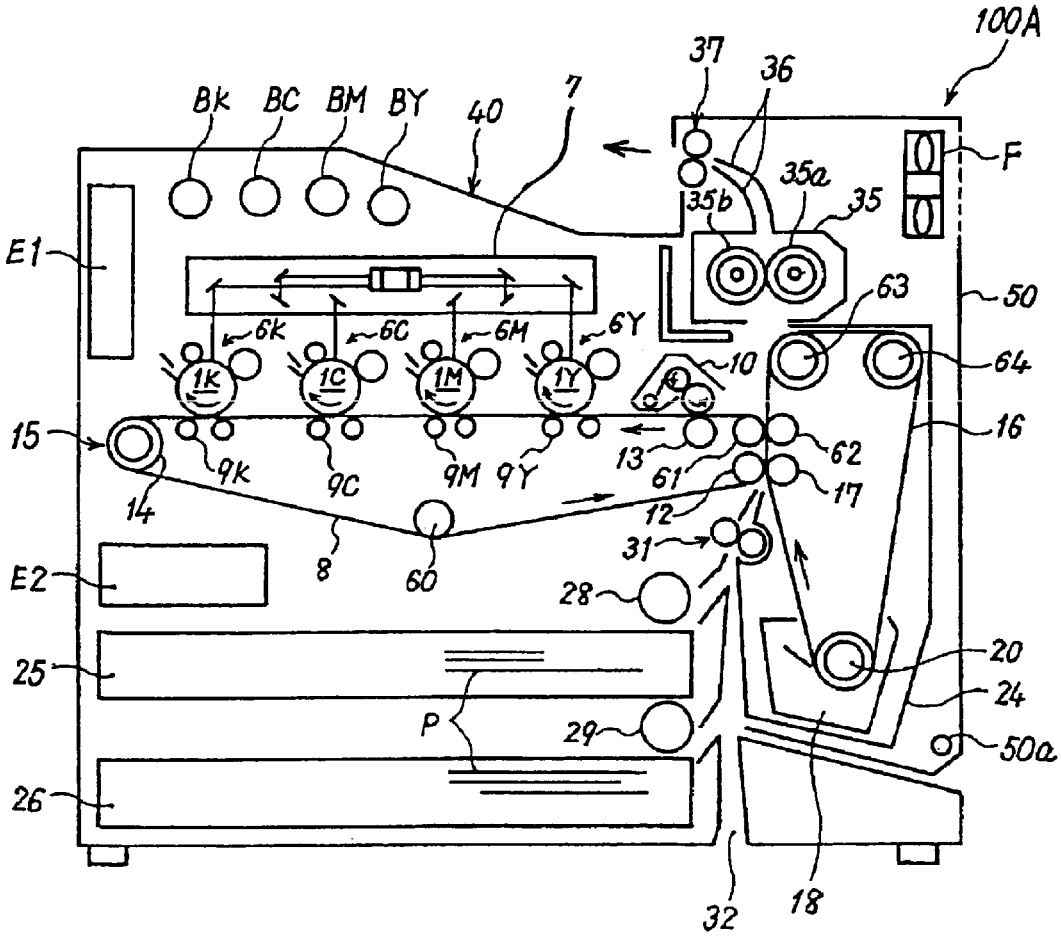
FIG. 6 is a view showing a modification of the illustrative embodiment.
Figure 7:
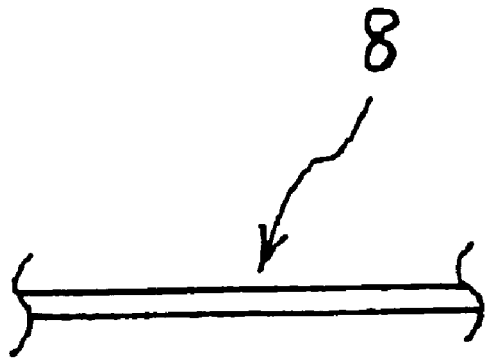
FIG. 7 is a fragmentary side elevation showing an intermediate image transfer belt having a single layer structure.
Figure 8:
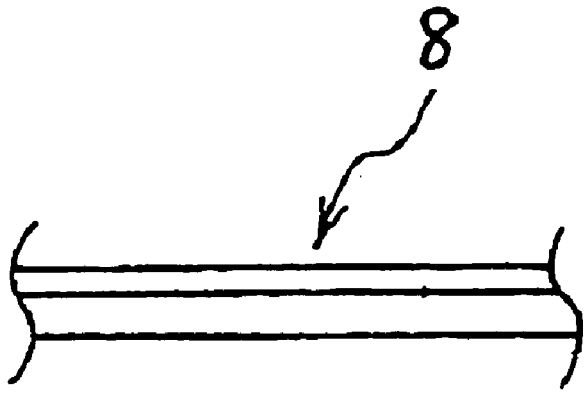
FIG. 8 is a view similar to FIG. 7, showing an intermediate image transfer belt having a laminate structure.

FIG. 6 shows a printer 100A that is a modification of the illustrative embodiment. As shown, in the modification, the process cartridges 6Y through 6K are positioned above the first image transferring unit 15 while the exposing unit 7 is positioned above the image transferring unit 15. In the image transferring unit 15, the first belt 8 is provided with surface roughness of 50° in JIS-A scale as in the illustrative embodiment. To implement such relatively low surface hardness, the belt 8 is provided with a laminate structure shown in FIG. 8 instead of a single layer structure shown in FIG. 7. In the structure of FIG. 8, any one of the layers is formed of an elastic material. As shown in FIG. 6, the belt 8 is passed over a second tension roller 60 and a backup roller 61 for tertiary image transfer as well as over the other rollers.

In the modification, the second belt 16 is provided with surface hardness of 95° in JIS-A scale as in the illustrative embodiment. Among the rollers over which the belt 16 is passed, the nip extension roller 19 and backup roller 21, FIG. 1, are absent. Also, the image transfer charger 23, FIG. 1, facing the backup roller via the belt 16 is absent. Instead, a tertiary image transfer roller 62, a separation roller 63 and a second tension roller 64 are added. The tertiary image transfer roller 62 and backup roller 61 sandwich the two belts 8 and 16, forming a tertiary image transfer nip.

The tertiary image transfer nip is contiguous with the secondary image transfer nip that the backup roller 12 and secondary image transfer roller 17 form by nipping the two belts. The separation roller 63, which is a substitute for the backup roller of the illustrative embodiment, causes the sheet P to part from the second belt 16 whose direction is changed by 90° by the curvature of the separation roller 63, while conveying the sheet P toward the fixing unit 35. The second belt cleaner 18 cleans the surface of the second belt 16 while being backed up by the tension roller 20.

Figure 9:
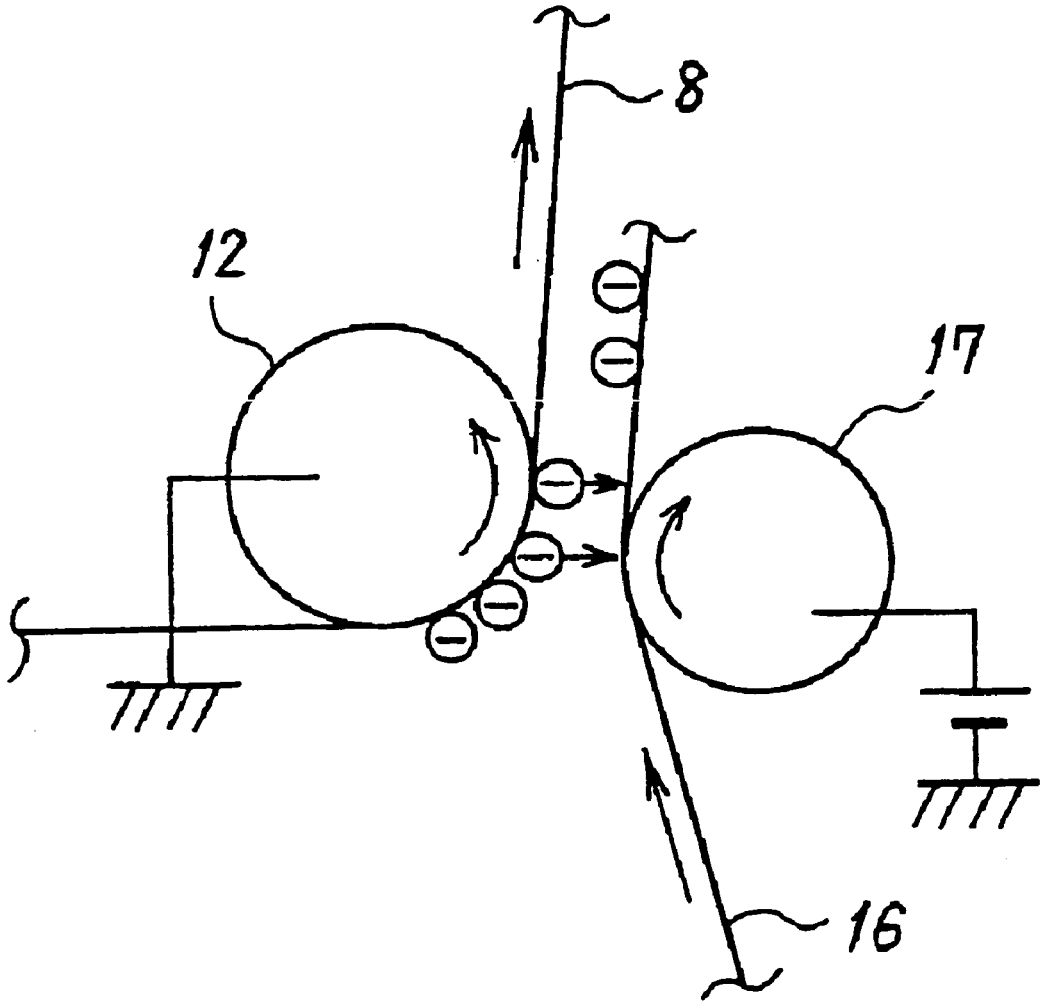
FIG. 9 is an enlarged view showing a secondary nip and arrangements around it.

FIG. 9 shows the secondary image transfer nip particular to the modification of the illustrative embodiment. As shown, the backup roller 12, pressing the two belts 8 and 16 against the secondary image transfer roller 17, is grounded. The secondary image transfer roller 17 is applied with a bias opposite in polarity to toner, e.g., a positive bias from a power supply. In this condition, the first toner image carried on the first belt 8 is electrostatically attracted by the secondary image transfer roller 17 and transferred to the second belt 16 thereby.

Figure 10:
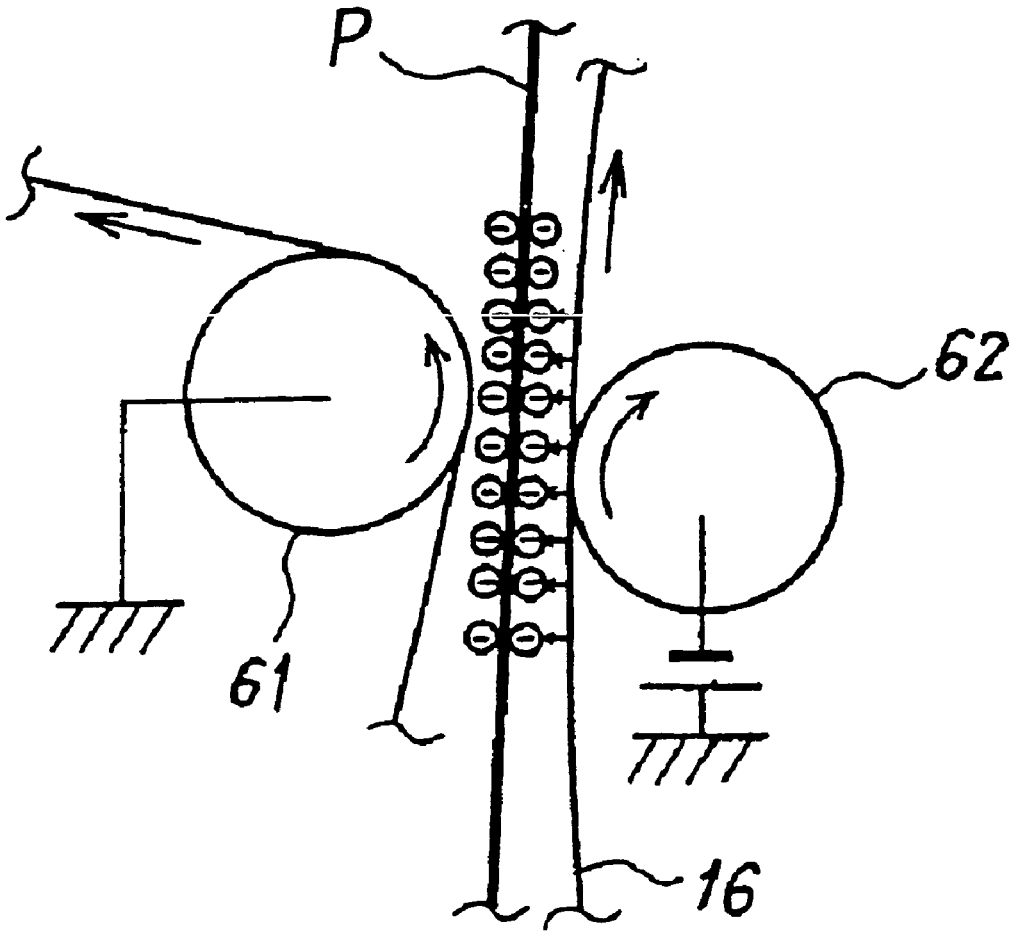
FIG. 10 is an enlarged view showing a tertiary nip and arrangements around it.

FIG. 10 shows the tertiary image transfer nip also particular to the modification. As shown, the backup roller 61 for tertiary image transfer, pressing the two belts 8 and 16 against the tertiary image transfer roller 62, is grounded like the backup roller for secondary image transfer. The tertiary image transfer roller 62 is applied with a bias of the same polarity as toner, e.g., a negative bias from a power supply. In this condition, the first toner image transferred to the second belt 16 is electrostatically attracted by the backup roller 61 and transferred to the first side of the sheet P being nipped between the two belts 8 and 16. More specifically, the bias for tertiary image transfer electrostatically forces out toner toward the acceptor.

We originally thought that tertiary image transfer of the kind described above forced out even the second toner image transferred to the second side of the sheet P at the secondary image transfer nip and returned it to the first belt 8. However, experiments showed that the second toner image was not electrostatically forced out, but was safely retained on the second side of the sheet P. Such tertiary image transfer therefore differs from the image transfer charger of the illustrative embodiment in that it transfers the first toner image to the sheet P while holding both of the first and second toner images in close contact with the sheet P. This obviates toner scattering ascribable to a charge applied to the bare first side of the sheet P and therefore insures high image quality. In addition, there can be obviated ozone ascribable to corona charge.

For comparison, a bias opposite in polarity to toner was applied to the backup roller 61 for tertiary image transfer while the tertiary image transfer roller 16 was grounded for effecting electrostatic attraction. This scheme was not successful because the above bias not only attracted the first toner image toward the first side of the sheet P, but also attracted the second toner image from the second side of the sheet P toward the first belt 8. It is therefore necessary to effect tertiary image transfer by the force-out type of electrostatic image transfer.

As stated above, the printer 100A, like the printer 100, transfers toner images to both sides of the sheet P being conveyed from the secondary image transfer nip toward the downstream side, i.e., by the one-pass system. Also, the sheet P does not directly contact the drums 1Y through 1K, so that the deposition of paper dust on the drums 1Y through 1K is reduced. Further, the second belt 16 is less deformable than the first belt 8 in the direction of thickness, obviating the problem described with reference to FIGS. 4 and 5. In the modification, the tertiary image transfer nip is formed in addition to the secondary image transfer nip by the two belts 8 and 16. In this respect, the second belt 16 less deformable than the first belt 8 is particularly effective.

The illustrative embodiment and modification thereof may be modified in various manners, as will be described hereinafter. The drums 1Y through 1K may be replaced with photoconductive belts. While the second belt 16 has been shown and described as being less deformable than the first belt 8, the latter may be made less deformable than the former. Powdery toner may be replaced with a developing liquid containing toner and carrier liquid. The electrostatic printer may be replaced with a direct recording type of image forming apparatus that causes a group of toner grains to fly toward an intermediate image transfer body or a recording medium in the form of dots. Further, while the primary, secondary and tertiary image transfer all are effected by electrostatic transfer, at least one of the three kinds of image transfer may be replaced with thermal heat transfer. Thermal heat transfer refers to a system in which a first intermediate image transfer body or similar donor and a second intermediate image transfer body or similar acceptor are caused to closely contact while being heated to thereby soften a toner image, and then the donor and acceptor are released from each other to transfer the toner image from the former to the latter.

Figure 11:
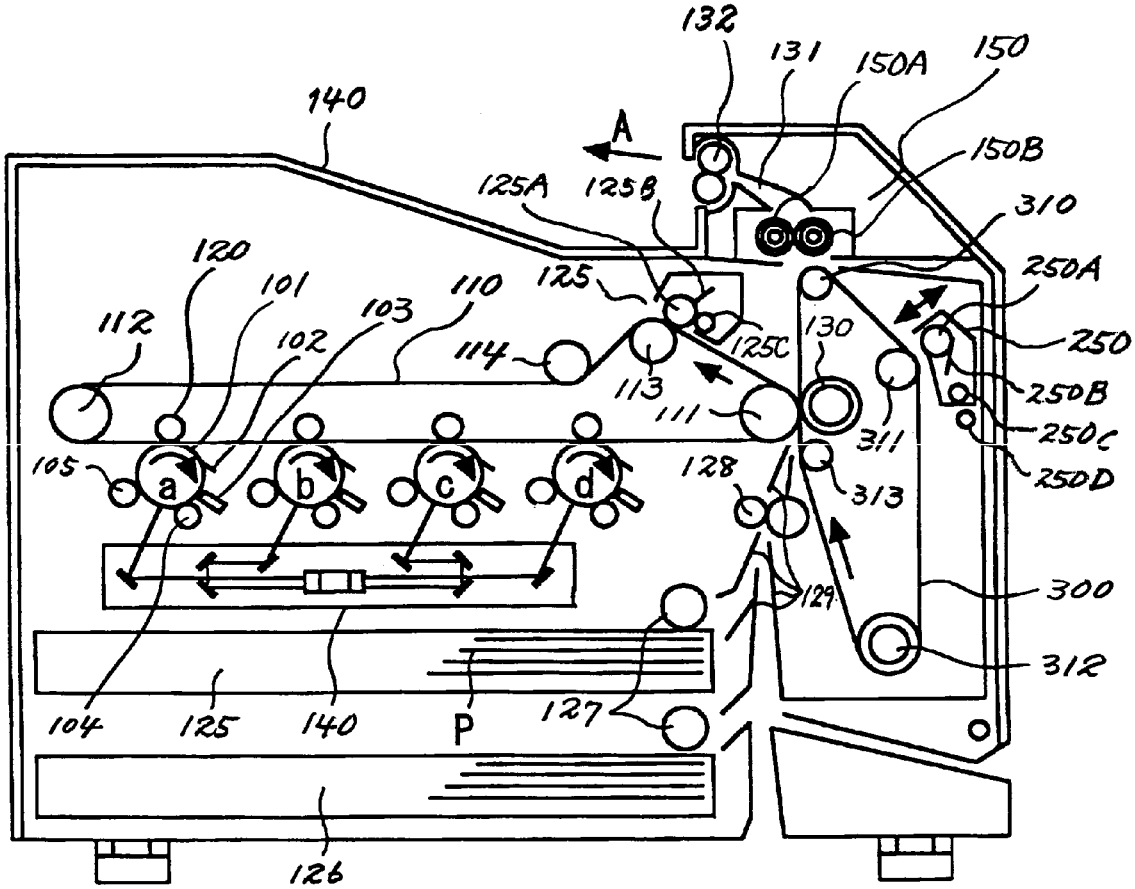
FIG. 11 is a view showing an alternative embodiment of the present invention.

Reference will be made to FIG. 11 for describing an alternative embodiment of the present invention, which is mainly directed toward the second object stated earlier. As shown, sheets P are stacked on sheet cassettes 125 and 126. A pickup roller 127, assigned to each of the sheet cassettes, pays out the top sheet P toward a registration roller pair 128 via a plurality of guides 129.

Photoconductive drums or latent image carriers 101*a* through 101*d* each are rotatable in a direction indicated by an arrow in FIG. 11. Arranged around each of the drums 101*a* through 101*d* are a drum cleaner 102, a quenching device 103, a charger 104, and a developing device 105. An exposing unit 103 scans each drum 101 with a light beam via a space formed between the charger 104 and the developing device 105. Process units arranged around the four drums 101*a* through 101*d* are identical with each other except for the color of toner to use.

Each drum 101 may be implemented as an aluminum drum having a diameter of about 30 mm to 100 mm and provided with an organic photoconductor layer or an amorphous silicon layer. The drum 101 may be replaced with a photoconductive belt, if desired.

The exposing unit 103 scans the surface of each drum 101, which is uniformly charged by the charger 104, with a laser beam in accordance with image data to thereby form a latent image. Alternatively, the exposing unit 103 may use an LED array and focusing means, as stated earlier.

Part of the drum 101 is held in contact with a first intermediate image transfer belt or first image carrier (simply first belt hereinafter) 110 passed over rollers 111, 112, 113 and 114 and movable in a direction indicated by an arrow in FIG. 11. The first belt 110 has a 20 μm to 600 μm thick base formed of resin or rubber and is provided with electric resistance that allows toner to be transferred from the drum 101 to the belt 110. The belt 110 should preferably be resistant to heat.

Four primary image transfer rollers or bodies 120 are arranged inside the loop of the first belt 110 in the vicinity of the four drums 101. While the image transfer rollers 120 may be replaced with chargers each including a discharge electrode, the rollers 120 are desirable because they are operable with relatively low voltage, which reduces toner scattering. The image transfer rollers 120 sequentially transfer toner images formed on the drums 101*a* through 101*d* to the first belt 110 one above the other, so that a color toner image is completed on the belt 110.

The roller 111, supporting the first belt 110 together with the other rollers, constitutes image transferring means A accommodating a heating body therein. Tension applying means is suitably associated with one of the rollers, which support the first belt 110, or an extra roller in order to apply tension to the belt 110. The rollers other than the primary image transfer rollers 120 are grounded.

Cleaning means 125 is positioned outside the loop of the first belt 110 and includes a cleaning roller 125A, a blade 125B, and collecting means 125C. After the cleaning blade 125A has removed residual toner left on the first belt 110, the blade 125B scrapes off the toner. Subsequently, the collecting means 125C conveys the toner to a storing section not shown. A heating body is disposed in the cleaning roller 125A for softening the residual toner, so that the roller 125A can easily remove the residual toner. The surface of the cleaning roller 125A is more rough than the surface of the first belt 110. The cleaning roller 125A may be formed of copper or aluminum having high thermal conductivity.

A second intermediate image transfer belt or second image carrier (simply second belt hereinafter) 300 is positioned at the right-hand side, as viewed in FIG. 11, and partly held in contact with the first belt 110. The second belt 300 is passed over rollers 310, 311, 312 and 313 and movable in a direction indicated by an arrow in FIG. 11. The second belt 300 has a 20 μm to 600 μm thick base formed of resin or rubber and should preferably be resistant to heat. A roller 130 is positioned inside the loop of the second belt 300 and accommodates a heating body therein to constitute image transferring means B.

Cleaning means 250 is positioned outside the loop of the second belt 300 and includes a cleaning roller 250A, a blade 250B, and collecting means 250C. After the cleaning blade 250A has removed residual toner left on the second belt 300, the blade 250B scrapes off the toner. Subsequently, the collecting means 250C conveys the toner to a storing section not shown. A heating body is disposed in the cleaning roller 250A for softening the residual toner, so that the roller 250A can easily remove the residual toner. The surface of the cleaning roller 250A is more rough than the surface of the second belt 300. The cleaning roller 250A may be formed of copper or aluminum having high thermal conductivity.

The first belt 110 and second belt 300 contact each other by being respectively pressed by the rollers, or image transferring means A and B, 111 and 130, forming a secondary image transfer nip. The secondary image transfer nip should preferably be 5 mm to 10 mm long. The rollers 111 and 130 each have an outside diameter of about 40 mm to 60 mm and may be provided with a surface layer formed of rubber, as needed. The thickness of the surface layer is so determined as to implement the required nip length in consideration of the thickness of the belts 110 and 300.

At the secondary image transfer nip, there are effected a step a of transferring a toner image from the first belt 110 to the second belt 300 and a step b of transferring toner images from the two belts 110 and 300 to both sides of the sheet P. In both of the steps a and b, the image transferring means A and B respectively heat the first and second belts 110 and 300 to temperature equal to or higher than the glass transition point of toner, but equal to or lower than the softening point of the same. A glass transition point may be measured by use of a differential scanning calorimeter. A softening point refers to temperature at which toner is softened and deformation ascribable to a load settles; for measurement, use may be made of a flow tester in accordance with a method described in JIS K 7210.

Heat and pressure thus acting at the secondary image transfer nip cause toner to plastically deform and adhere to the irregular surface of the sheet P. Toner should only adhere to the sheet P to such a degree that it does not part from the sheet P. This is why toner is not so heated as to fully melt, but is heated to temperature lying in the particular range stated above. Also, pressure to act on toner does not have to be high enough to cause the toner to firmly bite into the irregular surface of the sheet P, but should only be between 2 $N/cm^2$ and 10 $N/cm^2$.

In the illustrative embodiment using toners of a plurality of colors (four in FIG. 11), differences in glass transition point and softening point between the toners should preferably be small. Particularly, if either one of the above differences is 7° or less, then the same transferability is achievable with all of the toners, insuring desirable image transfer.

To enhance image transfer in the steps a and b, the surface roughness Rz of each latent image carrier 101, primary image transfer body 110 and secondary image transfer body 300 should preferably be sequentially increased in this order. This is because when toner plastically deforms, the transition of toner to a surface having higher surface roughness tends to occur.

In the illustrative embodiment, an electrostatic image transfer system is used to transfer a toner image from each drum 101 to the first belt 110. At this instant, by increasing the surface roughness Rz of the first belt 110, it is possible to further lower voltage necessary for image transfer. Further, because the sheet P to which the toner image is finally transferred has surface roughness Rz of 20 μm to 40 μm, the surface roughness Rz of the second belt 300 is selected to be lower than the surface roughness Rz of the sheet P.

The sheet P, carrying toner images on both sides thereof, is conveyed by the second belt 300, separated from the belt 300 due to the curvature of the roller 310, and then handed over to fixing means 150. The fixing means 150 includes a pair of fixing rollers 150A and 150B although it may alternatively include belts. The fixing rollers 150A and 150B each accommodate a heater therein and are made up of a metallic core and a silicone rubber layer formed thereon. Silicone rubber may be replaced with Teflon or similar resin having a high parting ability or rubber, if desired. The fixing members of the fixing means 150, whether they may be rollers or belts, should preferably have the same surface property in order to equally fix the toner images on both sides of the sheet P for thereby enhancing image quality.

The temperature of the fixing rollers 150A and 150B is controlled to 160° C. to 200° C. while pressure to act between the rollers 150A and 150B is controlled to 20 $N/cm^2$ to 100 $N/cm^2$. While the sheet P is being conveyed via the nip between the fixing rollers 150A and 150B, toner on the sheet P is fixed by heat and pressure.

The operation of the illustrative embodiment will be described hereinafter. A laser diode (LD), not shown, included in the exposing unit 140 emits a laser beam in accordance with image data of a particular color. The laser beam scans the drum 101*a*, which is uniformly charged by the charger 104, via optics, not shown, to thereby form a latent image on the drum 101*a*. The developing device 105 develops the latent image with toner for thereby forming a corresponding toner image on the drum 101*a*. The primary image transfer roller 120 transfers the toner image from the drum 101*a* to the first belt 110. More specifically, a bias opposite in polarity to the toner, e.g., a positive bias is applied to the image transfer roller 120 in order to effect the above image transfer.

The drum cleaner 102 removes the toner left on the drum 101*a* after the image transfer. Subsequently, the quenching device 103 discharges the surface of the drum 101*a* to thereby prepare it for the next image forming cycle.

The first belt 110, carrying the toner image thereon, is moved in the direction indicated by the arrow in FIG. 11. A latent image derived from image data of another color is formed on the drum 101*b* and then developed to become a toner image in the same manner as the above toner image. This toner image is then transferred from the drum 101*b* to the first belt 110 over the toner image existing on the belt 110. Such a procedure is repeated four times to complete a four-color toner image on the belt 110.

The second belt 300 is moving in the direction indicated by the arrow in synchronism with the first belt 110. The four-color toner image is transferred from the first belt 110 to the second belt 300 by heat and pressure at the secondary image transfer nip between the two belts 110 and 300. The image transferring means A and B each are controlled to temperature between the glass transition point and the softening point of the toner. Also, the pressure is selected to fall between 2 N/cm$^2$ and 10 N/cm$^2$.

When the first belt 110 reaches a preselected position, toner images are again formed on the drums 101*a* through 101*d* and transferred to the first belt 110, completing another four-color image to be transferred to the other side of a sheet P. At the same time, the pickup roller 127 associated with the sheet cassette 125 or 126 starts rotating counterclockwise, as viewed in FIG. 11, paying out the top sheet P toward the registration roller pair 128. The sheet P is then conveyed by the registration roller pair 128 to the nip between the first and second belts 110 and 300. At the nip, the toner image carried on the first belt 110 is transferred to one side of the sheet P by heat and pressure. At the same time, the toner image carried on the second belt 300 is transferred to the other side of the sheet P by the same heat and pressure as during the image transfer from the first belt 110 to the second belt 300.

The sheet P, carrying the toner images on both sides, is conveyed upward, separated from the second belt 300 by the curvature of the roller 310, and then handed over to the fixing means 150. After the toner images have been fixed on the sheet P by the fixing means 150, the sheet P is driven out to a stack tray 140 by an outlet roller pair 132.

Assume that the sheet P is driven out to the stack tray 140 in such a position that the toner image directly transferred from the first belt 110 to the sheet P faces downward. Then, to sequentially stack consecutive sheets P in order of page, it suffices to form the toner image of the second page first, transfer it to the second belt 300, and then directly transfer the toner image of the first page from the first belt 110 to the sheet P. Further, the toner image to be transferred from the first belt 110 to the sheet P is formed on the drum 101 as a non-mirror image while the toner image to be transferred from the second belt 300 to the sheet P is formed as a mirror image. Such arrangement of pages can be implemented by a conventional technology using an image memory. Also, exposure for switching the mirror and non-mirror images can be implemented by a conventional image processing technology.

After the transfer of the toner image from the second belt 300 to the sheet P, the cleaning device 250 removes residual toner left on the surface of the belt 300. In the illustrative embodiment, the cleaning device 250 is angularly movable about a fulcrum 250D into or out of contact with the surface of the second belt 300. The cleaning device 250 is spaced from the belt 300 when the toner image to be transferred to the sheet P is present on the second belt 300. When the belt 300 should be cleaned after image transfer, the cleaning device 250 is moved counterclockwise, as viewed in FIG. 11, into contact with the belt 300 and removes residual toner in the previously stated manner.

While two different image forming procedures are available in a simplex print mode, it is comparatively simple to transfer a toner image from the first belt 110 to the sheet P by omitting image transfer to the second belt 300. Again the sheet P, carrying the toner image on one side thereof, is driven out to the stack tray 140 with the toner image facing downward.

It is to be noted that the illustrative embodiment is applicable not only to color image formation shown and described, but also to monochromatic image formation.

As stated above, in the illustrative embodiment, heat and pressure used to effect the two consecutive image transferring steps a and b obviate toner scattering, blurring and other defects particular to electrostatic image transfer, thereby insuring high image quality. Particularly, heat confined in the particular range stated earlier saves energy and protects the drums 1*a* through 1*d* and process units arranged therearound from damage ascribable to heat. Further, the relation in surface roughness Rz between the drums, the first belt 110 and the second belt 300 stated previously insures desirable image transfer despite the above temperature range.

Various modifications will become possible for those skilled in the art after receiving the teachings of the present disclosure without departing from the scope thereof.

What is claimed is:

1. A method of transferring toner images to both sides of a recording medium, said method comprising the steps of:

causing surfaces of a first and a second intermediate image transfer body to endlessly move while forming a nip in contact with each other;

transferring a first toner image formed on an image carrier to said second intermediate image transfer body via said first intermediate image transfer body;

transferring a second toner image formed on said image carrier to said first intermediate image transfer body; and transferring, when a recording medium nipped by the nip is being conveyed toward a side downstream of said nip in a direction in which said surfaces move, said first toner image from said second intermediate image transfer body to a first side of said recording medium and transferring said second toner image from said first intermediate image transfer body to a second side of said recording medium;

wherein said second intermediate image transfer body is less deformable than said first intermediate image transfer body in a direction of thickness.

2. In an image transferring device comprising a first and a second intermediate image transfer body whose surfaces endlessly move while forming a nip in contact with each other, and configured to transfer, when a recording medium nipped by said nip is being conveyed toward a side downstream of said nip in a direction in which said surfaces move, a first toner image transferred from an image carrier to said second intermediate image transfer body via said first intermediate image transfer body beforehand to a first side of said recording medium and transfer a second toner image transferred from said image carrier to said first intermediate image transfer body beforehand to a second side of said recording medium said second intermediate image transfer body is less deformable than said first intermediate image transfer body in a direction of thickness.

3. The device as claimed in claim 2, wherein said first intermediate image transfer body has a laminate structure.

4. The device as claimed in claim 3, wherein said first intermediate image transfer body and said second intermediate image transfer body each comprise an intermediate image transfer belt passed over a plurality of support members and caused to endlessly move.

5. The device as claimed in claim 4, wherein at least one of said plurality of support members over which said first intermediate image transfer belt is passed comprises a bias applying member configured to apply a bias to an inside surface of said first intermediate image transfer body for thereby electrostatically transferring the toner image from said image carrier to said first intermediate image transfer belt.

6. The device as claimed in claim 5, wherein said first intermediate image transfer belt has surface resistance ranging from $10^5$ Ω·cm $^2$ to $10^{12}$ Ω·cm$^2$.

7. The device as claimed in claim 4, wherein at least one of said plurality of support members over which said second intermediate image transfer belt is passed comprises a bias applying member configured to apply a bias to an inside surface of said second intermediate image transfer body for thereby electrostatically transferring the toner image from said first intermediate image transfer body to said second intermediate image transfer belt.

8. The device as claimed in claim 7, wherein said second intermediate image transfer belt has surface resistance ranging from $10^5$ Ω·cm$^2$ to $10^{12}$ Ω·cm $^2$.

9. The device as claimed in claim 7, wherein said second intermediate image transfer body includes a base formed of polyimide.

10. The device as claimed in claim 9, wherein said second intermediate image transfer belt is 50 μm to 600 μm thick.

11. The device as claimed in claim 9, wherein said bias applying members over which said first intermediate image transfer belt and said second intermediate image transfer belt are respectively passed each comprise a rotatable roller.

12. The device as claimed in claim 2, wherein said first intermediate image transfer body and said second intermediate image transfer body each comprise an intermediate image transfer belt passed over a plurality of support members and caused to endlessly move.

13. The device as claimed in claim 12, wherein at least one of said plurality of support members over which said first intermediate image transfer belt is passed comprises a bias applying member configured to apply a bias to an inside surface of said first intermediate image transfer body for thereby electrostatically transferring the toner image from said image carrier to said first intermediate image transfer belt.

14. The device as claimed in claim 13, wherein said first intermediate image transfer belt has surface resistance ranging from $10^5$ Ω·cm$^2$ to $10^{12}$ Ω·cm$^2$.

15. The device as claimed in claim 12, wherein at least one of said plurality of support members over which said second intermediate image transfer belt is passed comprises a bias applying member configured to apply a bias to an inside surface of said second intermediate image transfer body for thereby electrostatically transferring the toner image from said first intermediate image transfer body to said second intermediate image transfer belt.

16. The device as claimed in claim 15, wherein said second intermediate image transfer belt has surface resistance ranging from $10^5$ Ω·cm$^2$ to $10^{12}$ Ω·cm$^2$.

17. The device as claimed in claim 15, wherein said second intermediate image transfer body includes a base formed of polyimide.

18. The device as claimed in claim 17, wherein said second intermediate image transfer belt is 50 μm to 600 μm thick.

19. The device as claimed in claim 15, wherein said bias applying members over which said first intermediate image transfer belt and said second intermediate image transfer belt are respectively passed each comprise a rotatable roller.

* * * * *